United States Patent [19]

Zimmerman

[11] 4,445,910

[45] * May 1, 1984

[54] GAS GENERATING SYSTEM AND PROCESS

[76] Inventor: Edwin H. Zimmerman, R.D. #1, New Holland, Pa. 17557

[ * ] Notice: The portion of the term of this patent subsequent to Sep. 7, 1999 has been disclaimed.

[21] Appl. No.: 396,869

[22] Filed: Jul. 9, 1982

Related U.S. Application Data

[63] Continuation-in-part of Ser. No. 231,987, Feb. 6, 1981, Pat. No. 4,348,211.

[51] Int. Cl.[3] ..... C10J 3/30; C10J 3/32

[52] U.S. Cl. ..... 48/76; 48/85.2; 48/86 R; 48/86 A; 48/111; 55/124; 55/385 R; 202/117; 202/121; 202/150

[58] Field of Search ..... 48/111, 209, 76, 86 A, 48/86 R, 85.2, 128; 201/7.5, 6, 4, 41; 202/99, 93, 85, 108, 121, 84, 150, 117, 118, 119; 55/124, 7, 385 R, 223, 233, 259

[56] References Cited

U.S. PATENT DOCUMENTS

| | | | |
|---|---|---|---|
| 996,603 | 7/1911 | Aslakson | 48/80 A |
| 1,049,994 | 1/1913 | Chapman | 48/86 A |
| 1,086,366 | 2/1914 | Hart | 48/111 |
| 1,107,917 | 8/1914 | Derrick | 48/86 A |
| 1,888,586 | 11/1932 | Chapman | 48/85.2 |
| 2,631,930 | 3/1953 | Peters . | |
| 3,835,796 | 9/1974 | Sanga | 55/223 |
| 3,852,048 | 12/1974 | Pyle . | |
| 3,853,506 | 12/1974 | Pircon | 55/223 |
| 3,929,585 | 12/1975 | Grimmett . | |
| 3,938,965 | 2/1976 | Pyle . | |
| 3,950,143 | 4/1976 | Pyle . | |
| 3,977,947 | 8/1976 | Pyle . | |
| 4,019,444 | 4/1977 | Kleebers et al. | 55/124 |
| 4,028,068 | 6/1977 | Kreuer . | |
| 4,052,173 | 10/1977 | Brimhall . | |
| 4,057,401 | 11/1977 | Boblitz . | |
| 4,086,144 | 4/1978 | Grulich et al. | 202/262 |
| 4,118,201 | 10/1978 | Yan . | |
| 4,157,958 | 6/1979 | Chou . | |
| 4,164,397 | 8/1979 | Hunt et al. . | |
| 4,225,392 | 9/1980 | Taylor | 48/85 |
| 4,249,855 | 2/1981 | Dhoudt | 201/41 |
| 4,348,211 | 9/1982 | Zimmerman | 48/111 |

*Primary Examiner*—William F. Smith

*Attorney, Agent, or Firm*—C. Hercus Just

[57] ABSTRACT

A gas generating system deriving useful BTU products from cellulosic waste material and comprising a conical shell to which the waste material is fed at the bottom and moved upwardly by an auger to permit the expanding walls of the cone to loosen the material by sintering action in the upper portion of the shell in a combustion zone located above the level of a row of air inlet ports substantially midway of the shell, the shell also having a gas accumulating chamber in the top thereof and a gas discharge device leading from the chamber to gas purifying and cooling mechanism including spray devices, a settling tank and liquid storage tank operating in a manner to re-use liquid incident to the operation of the spray devices. Operation of the controlled air delivery to the nozzles and cone also can be regulated to produce desirable amounts of charcoal and mechanism is included to remove the same from the cone.

35 Claims, 4 Drawing Figures

GAS GENERATING SYSTEM AND PROCESS

The application is a continuation-in-part of application Ser. No. 231,987, filed Feb. 6, 1981, now U.S. Pat. No. 4,348,211.

BACKGROUND OF THE INVENTION

Substantial efforts are being made at present to utilize and/or re-process waste material for producing useful products of either gaseous or solid nature. The present invention is directed particularly to the utilization of cellulosic waste material for the production of useful gas such as methane and sometimes historically known as wood gas, details of which are set forth below.

Before the advent of substantial consumption of natural gas for both industrial and domestic purposes, so-called illuminating gas was manufactured for many years from coal and especially bituminous coal which was roasted in various types of similar equipment such as shown in prior U.S. Pat. No. 996,603 to Aslakson, dated July 4, 1911; U.S. Pat. No. 1,049,994 to Chapman, dated Jan. 7, 1913, and U.S. Pat. No. 1,107,917 to Derrick, dated Aug. 18, 1914. In general, these devices feed coal from a level below a generating chamber in the upper portion of which combustion takes place in a manner to produce gas which rises to discharge means in the upper portion of the chamber where the burning occurs. Air is delivered to the charge of coal in the chamber from a location either below or part way up the mass of coal being delivered to the combustion area of the chamber. In general, the burning of coal for this purpose occurred in a well insulated chamber in which refractory material lines a metal shell to protect the metal from destruction.

Another early U.S. Pat. No. 1,086,366, to Hirt, dated Feb. 10, 1914, showed a device in which set sawdust is delivered to a combustion zone in a retort lined with fire brick for purposes of providing heat as distinguished from a useful gas. In addition, prior U.S. Pat. No. 2,631,930 to Peters, dated Mar. 17, 1953, shows a system in which sawdust is carbonized by an electric heater coil and ash passes out the bottom of the heater chamber while the gas produced from the sawdust is filtered.

Another prior U.S. Pat. No. 3,977,947, to Pyle, dated Aug. 31, 1976, discloses a device in which a hot fluidized bed of previously formed charcoal has injected thereinto woody material to also carbonize it to form gas and charcoal, the gas being purified by a cyclone unit and a gas scrubber.

U.S. Pat. No. 4,019,444 to Kleeberg et al, dated Apr. 26, 1977, pertains to a system in which refuse is burned in an incinerator and the incinerator gases are treated for discharge to the atmosphere by being decontaminated in various units such as a cooler, electrostatic precipitator, gas scrubber, clarifier and the like.

Prior U.S. Pat. No. 4,052,173, to Schulz, dated Oct. 4, 1977, and U.S. Pat. No. 4,225,392 to Taylor, dated Sept. 30, 1980, show pyrolysis apparatus in which material is fed into the top of reaction chambers and, in the Schulz structure, gaseous fuels are produced by simultaneous gasification of coal and pyrolysis of organic solid waste material, while in Taylor, organic material is delivered to the chamber and heated air and gases cause destructive distillation of the carbohydrate material and the generation of carbon monoxide and carbohydrate gases.

Prior U.S. Pat. No. 4,086,144, to Grulich et al., dated Apr. 25, 1978, discloses a conical device adapted to process float tar in a coking process by separating the float tar and converting it in a manner so that it can be processed either separately or together with the bulk of curde tar discharged from the lower portion of the tar separator.

The apparatus comprising the present invention patentably distinguishes over the above-described prior art in various ways described in detail hereinafter, the advantages of which are also clearly set forth, as follows.

SUMMARY OF THE INVENTION

There is abundant waste material and especially waste material of a cellulosic nature available for purposes of utilizing the present invention. A recent survey by the Division of Forestry of Florida has revealed that nearly one million tons of wood residue is deposited annually in landfills in that state alone. This conceivably can be salvaged for use as fuel, either directly for burning in furnaces and the like or for conversion to useful fuel such as gas. The farming industry also generates substantial quantities of waste material in the form of corn cobs, fodder, straw, waste vegetation, fence row trash and brush, and the like, much of which is convertible to useful fuel products. The lumber industry also generates vast quantities of waste in the form of chips, sawdust and bark, which similarly can be converted to useful fuel production.

As indicated from the foregoing discussion of certain prior art patents, the availability of this type of waste material for development of useful fuel has not gone unnoticed by enterprizing individuals and companies, but it is the principle object of the present invention to provide a system containing refinement not present in the prior art, as well as to provide further improvements over the structures specifically illustrated and claimed in the applicant's parent application, Ser. No. 231,987, filed Feb. 6, 1981, notwithstanding the fact that many of the basic principles disclosed in said prior application are present in the improvements described in detail below. For purposes of simplifying the present application, a repetition of the illustrations and description of applicant's prior application are omitted from the present specification but are incorporated therein by reference and description of the improvements thereover are set forth below in the specification, while the general objects of the invention with respect to said improvements and refinements are as follows.

It is among the principal objectives of the present invention to include the use of a metal shell in the form of a cone diverging downwardly at an angle not substantially less than about 35° and to feed waste material from the bottom of said cone upwardly by means of an auger supported adjacent the bottom of the cone to receive waste material delivered thereto by means of reciprocating rams which tend to compact the material advantageously to comprise an air lock to prevent the ingress of ambient air at the bottom of the cone, the auger being rotated to tend to loosen as well as feed the material upwardly into the cone where the diverging sidewalls of the metal cone tend further to loosen the waste material as it moves upwardly for contact by combustion air supplied by a circular row of circumferentially spaced inlet ports which determine substantially the lower limit of a combustion zone located above said ports and extending upwardly for engagement by agitating means operated by a shaft extending upwardly from the auger and having depending plow members which slowly move within and engage the combustion products immediately below a gas accumulating chamber in the upper portion of the cone as defined by top closure means connected to the upper edge of the side walls of the cone, the combustion of the material being of such nature that the cone may be made from mild steel of suitable thickness and is capable of long life without requiring the use of refractory insulating material or otherwise, particularly since the constant feeding of raw material upwardly from the lower portion of the cone also constitutes a certain amount of thermal insulation.

Another object of the invention is to provide at the top of the cone an air-heating chamber immediately above but separated from the gas-accumulating chamber in the upper part of the cone, the air-heating chamber receiving air from blower means, such as in a squirrel cage fan, to provide air within the heating chamber in a desired range of pressure, as controlled by a pressure sensitive switch in the circuit of an electric motor which drives the fan, and conduits extending, for example, from the periphery of the air-heating chamber respectively to each of the air inlet ports of the cone, whereby the combustion air delivered to the combustion zone of the cone is heated and thereby expedites combustion of the waste material.

A further object of the invention is to deliver the raw waste material to the bottom of the cone, as aforesaid, through closed chutes or conduits which extend downwardly along the exterior of the cone to the aforementioned ram means, raw material being delivered by augers or otherwise to the upper ends of said chute, and additional heated air delivery conduits extend from the air-heating chamber to said chutes for purposes of providing at least partial heating and drying of the raw material.

Still another object of the present invention is to control the operation of the ram means which feed raw material to the bottom of the cone by arranging the agitating means so as to be supported in a limited vertical floating manner which is accomplished by drive means mounted adjacent the lower end of the cone and connected directly to the auger, the shaft which drives the agitating means being axially movable through the auger which is supported against axial movement, and flexible means extend between a drive gear on the auger and a crossbar connected to the lower end of the shaft, and a limit switch being arranged in a circuit for the reversible electric motors which drive the ram mean so that when the agitating means on the shaft reach a predetermined lower position, the limit switch is engaged by the lower end of the shaft to energize the ram motors to deliver more waste material to the lower end of the cone which results in raising the agitating means, after a limited operation of the ram means, whereby the lower end of the shaft disengages the limit switch and stops operation of the ram means, such limited floating movement of the agitating means being effected to provide a more uniform sintering of the material in the combustion zone.

One further object of the invention is to provide, preferably on the upper portion of the agitating means, a disc which actually is disposed in the gas-accumulating chamber in the upper part of the cone for purposes of somewhat retarding the speed of gas being discharged from the gas-accumulating chamber, said disc having a tendency to accumulate fine particles of combustion material such as charcoal and a limited amount of ash, removal means in the form of a scraper suspended from the lower wall of the air-heating chamber being adapted to engage the upper surface of the disc as it slowly rotates with the agitating means and move the accumulated material back into the gas-accumulating chamber for subsequent entrainment therein and removal with the gas as discharged in accordance with the invention.

Still another object of the invention is to remove gas from the gas-accumulating chamber by means of a compartment preferably extending through the air-heating chamber but separated therefrom and including a laterally extending conduit through which the gas and any entrained particles pass due to suction means being included downstream from the cone, and liquid spray being introduced into said conduit as the gas and entrained particles move therealong, or by such particles, at least to a large extent, are entrained in the liquid and such gas and particle-laden liquid moves to a separating device immediately prior to such suction means, the particle-laden liquid being conducted down a depending conduit which includes a liquid trap and continues to the inlet of a closed settling tank in which the heavier portion of the liquid settles to the lower part thereof for subsequent removal to a holding tank, while the gas is delivered to further high pressure spray equipment and purifying apparatus before being discharged from the system as clean, usable gas.

Still another object of the invention ancillary to the foregoing object is to further include a liquid supply tank which receives from the upper portion of the settling tank relatively clean liquid, which primarily is water, and communicating with the water supply tank is a plurality of pumps respectively of low pressure and high pressure characteristics, the low pressure pump being arranged to deliver water to the spray means for the conduit leading from the outlet compartment of the gas-accumulating chamber and a second pump of high pressure capacity delivering liquid to the high pressure spray means for the gas referred to above.

A still further object of the invention is to arrange the combustion of the waste material in such manner within the cone that, in addition to producing useful gas, such as methane or carbon monoxide, a substantial portion of coke can be produced and removed from the combustion zone, at a location between the air inlet ports and the agitating means, through a suitable conduit which extends radially from the wall of the cone and in which gathering means comprising an auger is located and projects at the inner end of the auger into the sintering material beyond the end of the conduit and causes the charcoal to be delivered to the conduit and moved therealong, while the agitating means tends to move the charcoal in the upper portion of the combustion zone to provide a continuous supply to the gathering means, the invention further including cooling means for the charcoal in the form of additional auger and conduit means extending through a water jacket which is supplied via one of the aforementioned pump means and conduits with cooling water which subsequently is discharged to the settling tank and water supply tank.

In view of the fact that cooling of the gas at various locations in the system and also cooling of coke when produced requires relatively cool liquid such as water, the present system also includes a cooling tower to which water from the upper portion of the settling tank is pumped to the cooling tower and the cooled water is returned to the settling tank and water supply tank for Also extending between the upper portion of the walls of cone 10 and fixed thereto is a second panel 68 of similar material to that of closure 64 and preferably substantially parallel thereto but spaced vertically therefrom to define an air heating space 70 for purposes to be described. Said space is provided with air under limited pressure which is forced into the space by a suitable fan 72, such as a squirrel cage fan, operation of which is by a motor, not shown, connected to the fan and operation of the motor being controlled by a pressure sensitive switch 74 responding to pressure within the space 70. Air is introduced from the fan 72 into space 70 by a conduit 76 communicating with a hole in the top closure 64.

Extending around the periphery of cone 10 approximately midway between the upper and lower ends thereof is a row of air inlet ports 78 through which nozzles 80 of smaller diameter than the ports 78 introduce air into the cone 10 to define substantially the lower end of the combustion chamber or zone 54 in which sintering and combustion of the cellulosic waste material occurs by means of the air introduced into the cone through the nozzles 80. As shown in phantom at the right-hand side of FIG. 3, it will be seen that the nozzles 80 are removable from the ports 78 for several purposes. One purpose is to permit the initiation of combustion of the waste material in the cone 10 by directing blow torches into the material and start combustion thereof, followed by the introduction of air through the nozzles 80. In accordance with the preferred embodiment of the invention, the air delivered through the nozzles 80 is heated air received from the air heating space 70 through the means of a plurality of tubes or conduits 82 respectively extending from the periphery of heating space 70 individually to the nozzles 80 as best shown in FIG. 3. The use of heated air is considered superior to that of cooler air for the intended purpose and the level of the nozzles 80 substantially defines the lower end of the combustion zone 54.

Preferably, the material to be converted within the cone 10 does not extend to the top thereof. Instead, the upper portion of the space in the cone 10 immediately below the second panel 68 is a gas accumulating chamber 84 which comprises the upper end portion of the interior of cone 10, above the top level of the mass of material being sintered and charred within the combustion zone 54.

Fixed to the upper portion of shaft 42 is agitating mean 84 which is specifically illustrated as a cross member or beam 86, an enlarged cross sectional view of which is shown in FIG. 4. From FIG. 4, it will be seen that material smoothing plates 88 are fixed to the cross member 86 and said plates include a forward vane 90 which extends above the horizontal at a greater angle than the trailing vane 92, due to rotation of the smoothing plate 88 in the direction of the arrows 94 shown in FIGS. 2 and 4. Due to the rotation of the cross member 86 with the smoothing plates 88 thereon in the recited directions, it will be seen that said smoothing plates engage the upper surface of the material being sintered and maintain it substantially at an even surface, above which the gas accumulating chamber 84 is located.

In addition to the smoothing effect afforded by the plates 88, the agitating mean includes a plurality of depending plow members 96 which extend an appreciable distance down into the mass of material being sintered and agitate the same to enhance the sintering and for other purposes described below. The members 96 are braced by gussets 98 and are of a very durable nature due to appropriate material being selected for the construction thereof. Rotation of the agitating means within the mass of material is relatively slow to provide for gradual sintering due to the fact that no substantial amount of actual burning and consumption of generated gas is desired and prevention of the same is maintained as far as possible. As the sintering progresses however, gas, together with relatively fine particles of combustion such as ash and especially fine particles of charcoal are produced. To assist in transfer of the gases, as produced, from the upper portion of the sintering mass of material to the chamber 84, a circular disc 100 is fixed to and rotated by shaft 42, immediately above the cross member 86 and preferably resting thereon. Said disc functions as a baffle to direct and somewhat retard the movement of gas to the chamber 84. In the course of its operation, relatively fine particles of combustion such as ash and especially very fine particles of charcoal tend to accumulate upon the upper surface of disc 100 and to remove the same therefrom, the invention includes a somewhat tangentially disposed scraper blade 102, the angle of which with respect to the axis of shaft 42 is best seen in phantom in FIG. 2. Said solid particles are moved to the edge of disc 100 and to a large extent are entrained in the gas for discharge from the chamber 84 by means described below.

Another function for having the nozzles 80 removable from the ports 78 is to afford access to the interior of the cone 10 and sequentially to the combustion zone 54 in order that rods or pokers may be inserted through the ports into the combustion zone for purposes of breaking up clinkers and the like, if necessary. Still another advantage of the particular arrangement of the nozzles 80 with respect to the tubes 82 is that the outer end 104 preferably is closed by heat resistant glass and thereby permit viewing of the combustion occurring within zone 54. Unrelated to the foregoing improvement but nevertheless comprising another feature of the invention resides in the fact that heating of the incoming raw waste material may be achieved at least to a limited extent by providing heated air conduits 106, shown in FIGS. 1–3, which extend from the periphery of the air heating space 70 to the upper inlet of the receiving chutes 26 through which the raw material is directed to the rams 28, thus providing at least partial drying of the material to minimize the occurrence of moisture within the cone 10. Movement of the partly heated raw material to the cylinders 30 for engagement by rams 28 occurs sequentially due to the fact that, as shown in FIG. 3, when the ram 28 is in the forward position, it closes the exhaust end of the receiving chute 26.

Removal of the generated gas and any solid particles of combustion entrained therein is undertaken through an opening 108 in panel 68 which constitutes a discharge port, the gas being received in a compartment 110 in the nature of a housing, the lower portion of the walls of which extend through the air heating space 70 so as not to be in communication therewith. A discharge conduit 112 extends laterally from a port in one side of the compartment 110 as best shown in FIG. 3, the conduit 112 preferably flowing downwardly a limited extent as shown in FIGS. 1 and 3 for purposes of subjecting the gas and entrained particles to a water spray, preferably of relatively low pressure, through the means of spray nozzles 114, the conduit 112 having a horizontal extension 116 in which additional spray nozzles 114 are located for purposes of entraining the solid delivery where required by the aforementioned low pressure and high pressure pumps.

Details of the foregoing objects and of the invention, as well as other objects thereof, are set forth in the following specification and illustrating in the accompanying drawings comprising a part thereof.

SUMMARY OF THE PREFERRED EMBODIMENTS OF THE INVENTION

Figure 1:
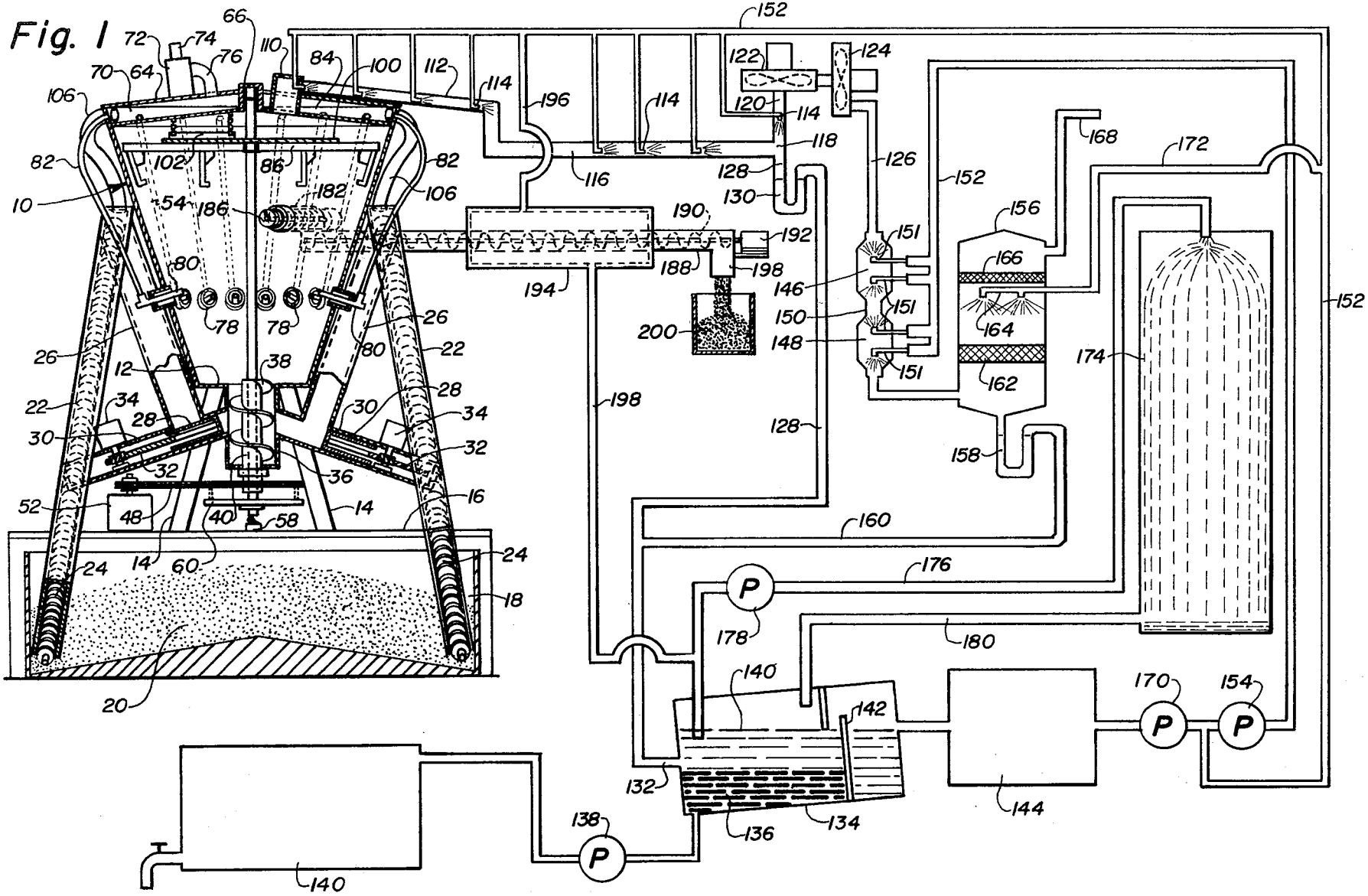
FIG. 1 is a somewhat diagrammatic side elevation of the gas generating system embodying the principles of the present invention, portions of the elements of the system being shown in vertical section.

Referring to the drawings, in FIG. 1, there is illustrated, largely in diagram form, a layout of all of the principal elements and units comprising the system of the invention. As can be seen from the figures, and especially FIGS. 1 and 3, the basic element of the system comprises a metallic conical shell referred to hereinafter as a cone 10. The cone preferably is made from mild steel of suitable thickness such as of the order of one-quarter inch and it will be noted that no insulation is required to be included in the cone, either of a ceramic nature or otherwise, except for such insulation as is afforded by the waste cellulosic material disposed in the cone as progressively fed thereto for the generation of useful gas such as methane, carbon monoxide, and otherwise and, depending upon the nature of operation of the system, substantial portions of charcoal also can be manufactured for the formation of valuable commercial products such as charcoal briquettes and otherwise. In applicant's prior application Ser. No. 231,987, the cone shown therein had a diverging angle of approximately 45°. In the cone 10 of the present drawings, the walls diverge at an angle of approximately 35° and it is preferred that the angularity of the walls be not appreciably less than 35°. The purpose of the cone in conjunction with the feed of material thereto is described in detail below.

The cone 10 is slightly truncated at the bottom and has a bottom wall 12 of steel similar to that of the side walls of the cone, the cone being supported by a plurality of angularly disposed legs 14 welded at the upper ends thereof to the bottom wall 12 and adapted to be disposed upon any suitable supporting surface. In FIG. 1, the legs 14 are shown mounted upon a surface 16 which is diagrammatic and corresponds to any suitable surface such as a floor in a manufacturing plant. Also shown in FIG. 1 is a compartment 18 representing what actually may comprise a silo or other storage facility for the raw waste material 20, such as sawdust, wood chips, and agricultural products such as corn cobs, fodder, straw, waste vegetation, fence row brush and otherwise. Such material is capable of being stored satisfactorily in silos and, as diagrammatically shown in FIG. 1, the material is gradually fed from the storage compartment to chutes or conduits 22 in which augers 24 are mounted for rotation by power means, not shown.

Receiving chutes 26 extend substantially vertically along the exterior walls of cone 10 at opposite sides thereof as shown in FIG. 1 and receive the waste material which is gradually discharged from the chutes 22 to fall by gravity to feed means comprising rams 28 slidable into cylinders 30 which communicate with the lower ends of the chutes 26, the rams being reciprocable in opposite direction by screws 32 engaged by worm gears on the drive shafts or reversable electric motors 34. The operation of the rams 28 is periodical and sequential and effected by the following control mechanism.

Extending downward from the bottom wall 12 is a cylindrical extension 36 within which additional feed means in the form of an auger 38 is rotatably mounted. The flights of the auger 38 are connected to a tubular shaft 40 and a preferably solid shaft 42 extends entirely through the tubular shaft 40. The lower ends of both tubular shaft 40 and the shaft 42 extend through a bearing 44 fixedly carried by the transverse bottom wall of cylindrical extension 36. Secured to the tubular shaft 40 is a sprocket gear 46 as shown in plan view in FIG. 2 and around which an endless chain 48 extends, the chain also extending around a spur gear 50 on the drive shaft of electric motor 52 which rotates the tubular shaft 40 and auger 38 in a direction to elevate material delivered to the extension 36 by the rams 28 which reciprocate in cylinders 30 that communicate with the sidewalls of the extension 36. This operation tends to compact the material especially in the delivery end of the cylinders 30 and this serves a beneficial purpose of operating as an air lock to prevent the ingress of any appreciable amount of ambient air into the lower part of the cone 10. By the function of auger 38 however, there is a tendency to gradually loosen the compacted material delivered to extension 36 and, in conjunction with the tapered nature of cone 10, there is a progressive gradual and limited loosening of the material as it ascends to the combustion chamber 54 in the upper portion of the cone, as described in detail below.

The shaft 42 extends at the lower end thereof beyond the lower end of tubular shaft 40, whereby the lower end 56 of shaft 42 is adapted to engage the actuator of a limit switch 58 of an electric circuit which is connected to the electric motors, said motors otherwise being controlled at the opposite ends of the limit of movement thereof in reversible direction by additional limit switches not shown but of conventional nature. Affixed to the lower end 56 of shaft 42 is a cross bar 60 and flexible means in the form of chains 62 extend between the opposite ends of the cross bar 60 and suitable connecting loops on the lower surface of sprocket gear 46 in order to provide for limited vertical floating movement of the shaft 42 along its axis for purposes to be described. By the mechanism just recited however, it will be seen that motor 52 commonly drives the shafts 40 and 42 unitarily in the same direction.

Figure 3:
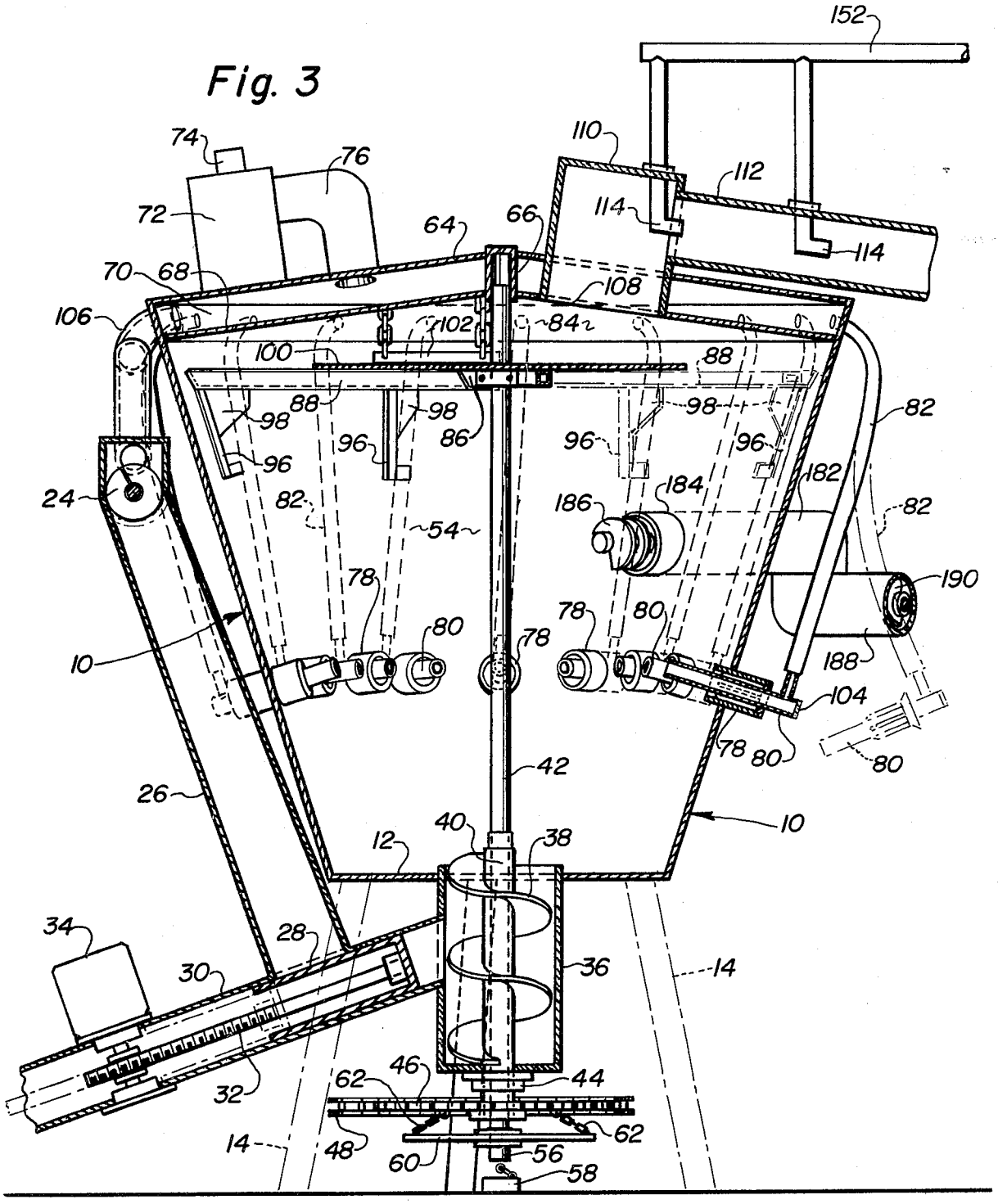
FIG. 3 is a vertical sectional view of the gas generating shell shown in FIG. 2 as seen on the line 3—3 thereof.

The upper end of the cone 10 is closed by a top closure 64 which is of sheet metal similar to that from which the cone 10 is formed, possibly of lighter gauge, and as shown in FIGS. 1 and 3, the closure 64 is in the form of a preferably relatively flat cone, which supports centrally thereof an upper bearing 66 in which the upper end of shaft 42 is disposed for limited vertical movement. The periphery of the closure 64 is securely welded to the top edge of cone 10 so as to be airtight.

particles therein and free the gas from containing the same at least to a very large extent, the gas and the liquid with entrained particles therein is conducted by suction means to a separating member 118 which has a riser 120 in which another spray nozzle 114 preferably is located directly below suction means which also preferably comprise a pair of fans 122 and 124, the fan 122 preferably being horizontal while the fan 124 preferably is vertical and each are driven by directly connected electric motors which are serviced by electrical conduits not shown. The purpose of the multiple fans is to control the rate of gas generation by the combustion zone of the cone 10 in that the suction provided by the fans, either singly or jointly, can be used to control the rate as well as the quantity of gas drawn from the accumulating chamber 84. Suitable control of the fans 122 and 124 can be arranged by an appropriate console, not shown, and operation thereof is in accordance with the rate of production desired, also in relation to the operation of the fan 72 and the pressure sensitive switch 74 by which the discharge of combustion air to the combustion zone 54 also is controlled. Further, the provision of multiple fans provides a backup system to prevent complete shutdown of the system in the event one of the fans fails for some reason and operation of the system may occur with a single fan after suitable adjustment of the other operating requirements has been made.

It will be seen that the illustrated separating member 118 is simply a tee, the stem 120 being a riser for transmission of gas through the fan and delivery thereof to an outlet conduit 126, while liquid and combustion particles entrained therein pass through the depending conduit 128 which comprises a section of the head of the tee 118, this being connected to a liquid trap to prevent the upward passage of any gas or air therethrough, the depending conduit 128 also extending downwardly to an inlet 132 of a settling tank 134, which preferably slopes a limited extent as shown in FIG. 1 in order that the heaviest components 136 of the liquid may take place by gravity. It has been found that these heavier components are somewhat of an oily nature and actually contain fuel properties, whereby, as the material accumulates it may be pumped by pump 138 to a holding tank 140 and subsequently used for fuel or other purposes. Meanwhile, the lighter liquid portions rise to the upper portion of settling tank 134 and primarily constitute relatively clean water 140 which may be used. Further, after passing through baffle means 142, said relatively clear water may pass to a water supply tank 114 by gravity for purposes described below.

It has been found in operation of the system that further purification of the gas discharged to outlet conduit 126 preferably should be subjected to further purification and this is accomplished by means of a pair of high pressure spray compartments 146 and 148 in which pairs of spray nozzles 151 preferably extend in opposite directions and the compartments are connected by a constricting venturi throat 150. The liquid for said sprays is provided through a conduit 152 which extends to a high pressure pump 154 which obtains relatively clean liquid from supply tank 144. The liquid entrains further inpurities from the gas in compartments 146 and 148 and such liquid flows into the lower portion of purifying unit 156 which discharges into a gooseneck 158 comprising a water trap and from there the conduit 160 returns the water and entrained solids to inlet 132 of the settling tank 134 in which the entrained particles can settle therefrom in the manner described above with respect to other contaminated liquid.

The fans 122 and 124 operate as suction fans with respect to the discharge conduit 112 and its extension 116, while the outlet from the fan functions as pressure to force the gas through the spray compartments 146 and 148 and force the same into the lower end of purifying unit 156 for passage through filter medium 162. As the gas exits upwardly therefrom, it is subjected to further spray nozzles 164 to entrain any remaining particles therein before the gas rises through a mist eliminator 166, whereby relatively dry, clean gas is discharged through exit conduit 168 to any location of use such as delivery to a motor-generator unit operating upon combustible gas, or otherwise.

The spray nozzles 114 and 164 need not be high pressure sprays and therefore these are supplied by a relatively low pressure pump 170 which communicates with the water supply tank 114 and by means of the conduit 152 delivers relatively clean liquid to the spray nozzles 114, while through a branch conduit 172 the spray nozzles 164 in the purifying unit 166 are supplied with relatively clean liquid.

The function of the spray means is not only for purposes of entraining solid particles of combustion such as ash and very fine charcoal particles as well as other impurities but is also for purposes of cooling the gas in order that when the same is discharged through conduit 168, it is not only clean but also relatively cool. Since the cooling is achieved via the sprays, it necessarily follows that the spray liquid is heated and in order to return the liquid to relatively cool condition for further use, the present system also includes a cooling tower 174. A delivery conduit 176 extends from the top of the housing of the cooling tower 174 to pump 178 which draws relatively clear or clean liquid from the upper portion of the accumulated liquid in settling tank 134. Falling of the water spray through the cooling tower 174 cools the liquid in customary manner of the operation of cooling towers and the spray falls by gravity to the bottom of the housing of the tower for return by gravity through conduit 180 to the upper portion of settling tank 134.

CHARCOAL PRODUCTION

Figure 2:
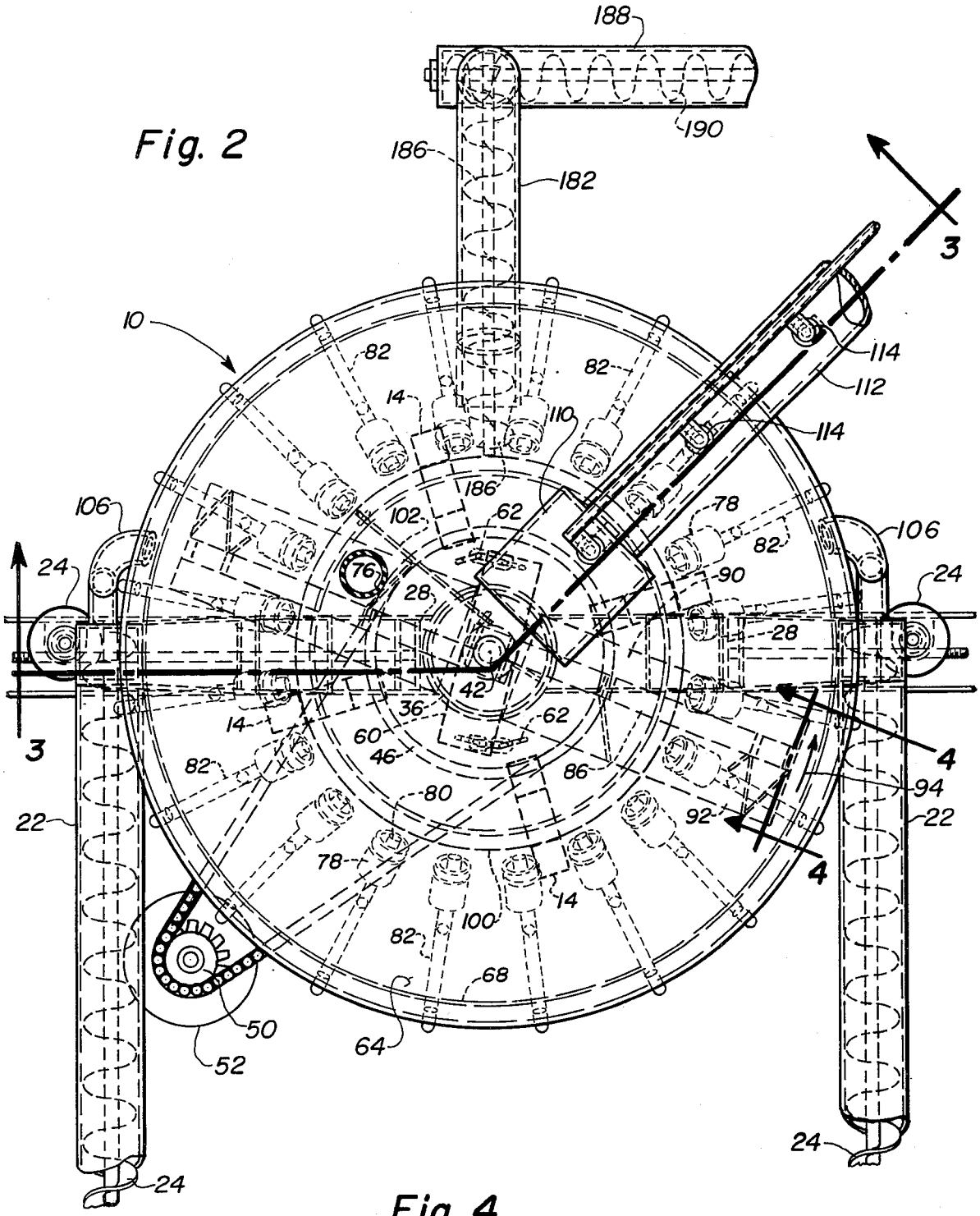
FIG. 2 is an enlarged top plan view, partly fragmentary, of the conical generating shell and equipment connected thereto as shown at the left hand end of FIG. 1.
Figure 4:
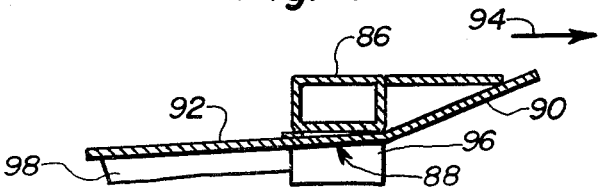
FIG. 4 is a transverse sectional detail view of an element of the mechanism shown in FIG. 2 as seen on the line 4—4 thereof.

It has been indicated in the foregoing that operation of the combustion of material in the cone 10 can be regulated so as to produce desirable quantities of charcoal with, for example, a relatively small proportion of usable gas. Under circumstances where charcoal is the principal desired product, such operation is possible. The charcoal occurs in the combustion zone 54 and to effect removal thereof, a conduit 182 is provided which extends through an opening 184, see FIG. 3, in the wall of the cone 10 and extends substantially radially therefrom as shown in FIG. 2. This arrangement may be varied as to angularity of the conduit 182. Gathering means are movably mounted within the conduit 182 in the form of an auger 186, the inner end of which extends beyond the inner end of the conduit 182 for direct engagement with the body of the charcoal within the combustion zone 54. It will be seen that conduit 182 and auger 186 are located in spaced relation to the air inlit nozzles 80 above the same a predetermined amount but below the lower ends of the plow members 96 of the agitating means so as not to interfere with the gradual plowing operation of the members within the mass of material being sintered and thereby produce the charcoal when such production is desired, through regulation of the air inlet mean from heating space 70 as also controlled by operation of the suction fans 122 and 124. The delivery of the raw material to the combustion zone also is controlled by the engagement of limit switch 58 by the lower end 56 of shaft 42 which supports the agitating mean with respect to the upper portion of the combustion zone in a manner to afford limited floating vertical movement so that the agitation and plowing function of the plow members 96 may operate in a manner to afford a desirable supply of charcoal for engagement by the gathering auger 186 for delivery to an extension conduit 188 in which another auger 190 is rotatably mounted by motor 192. Conduit 188 is encircled by a water cooled housing or chamber 194 which derives cooling water through a branch conduit 196 connected to conduit 152 and after heat transfer occurs, the heated water discharges through conduit 198 to the upper portion of settling tank 134 and subsequent recooling of the same by cooling tower 174.

The cooled charcoal exits from end 198 into any desired type of removal mechanism 200. Under some circumstances, the cooled loose particles of charcoal may be delivered to bagging means and distribution to customers for such material.

Particularly from FIG. 1 of the drawings, it would appear that the system is of such nature that is consumes substantial space but this actually is not a fact from at least one test installation that is in operation at the time of preparing this application. Solely for purposes of illustration and completely without restriction thereto, the cone 10, from the bottom of the legs 14 to the top cover 64 is approximately 10 feet. The diameter of the upper end of the cone is approximately 8 feet and although the purifying unit 156 is shown in FIG. 1 as being remote from the cone, it actually is supported substantially adjacent the cone and a number of other elements illustrated in FIG. 1 likewise are much more compact than shown in the drawing.

From the foregoing, it will be seen that the present invention comprises a highly efficient system of relatively simple nature for converting what otherwise is useless waste cellulosic material into highly useful products such as combustible gas which may be employed in a number of different capacities and especially for purposes of driving a motor-generator set capable of being energized by methane, carbon monoxide and the like. Further, the system may be regulated to produce charcoal of a very useful type and especially a powdered type from which charcoal briquettes may be formed in quantity and thus far, one such plant embodying the present invention has been placed in operation in which the production of gas is minimum compared to the production of charcoal which, after being cooled, is conveyed directly to bagging equipment in which it is sent directly to the briquette manufacturer.

Other installations of the type illustrated and claimed are now in operation and in addition to utilizing electric energy to drive the equipment in the plant, actually generate enough to sell surplus current to a local electric company. In a plant having a cone of the size referred to above in exemplary manner, it has been found that such plant, when consuming between 600 and 700 pounds of waste material per hour, is capable of generating between 160 and 180 KW per hour. To drive the motor generator set referred to above, the exemplary consumption of waste material per hour has been found to produce between 500 and 550 cubic feet of usable gas per minute for utilization in the motor generator set. It is to be understood however that the foregoing specific descriptions are solely exemplary and are not to be considered restrictive since the size and capabilities of a plant embodying the invention may be substantially varied.

The foregoing description illustrates preferred embodiments of the invention. However, concepts employed may, based upon such description, be employed in other embodiments without departing from the scope of the invention. Accordingly, the following claims are intended to produce the invention broadly, as well as in the specific forms shown herein.

I claim:

1. A system to generate gas products having useful B.T.U. values from waste cellulosic materials capable of being sintered and charred and comprising in combination:

a. a metallic generator shell comprising a cone free of permanent insulation, positioned vertically, and tapering downwardly at a diverging angle of not substantially less than 35°, said shell also having means in the upper portion thereof to discharge the said products of combustion, b. a closure for the top of said generator shell which with the walls of the shell forms a gas accumulating chamber in the upper portion of the shell, c. material inlet means in the bottom of said shell, d. means to feed waste material compactly and progressively into said inlet means for gradual movement upwardly in a manner to permit the angle of divergence of the shell to cause loosening of the material as it moves upwardly in the shell.

e. controlled air inlet ports spaced circumferentially around said shell substantially adjacent the vertical midportion of said shell and adapted to form a sintering type combustion zone with waste material only in the portion thereof above the level of said ports, f. gas outlet means communicating with and extending from the upper portion of said gas accumulating chamber, g. suction means downstream from the gas accumulating chamber to said shell and operable adjustably to induce the inlet of ambient air into said combustion zone through said ports, h. agitating means supported in the upper portion of said shell and engageable with the upper portion of the material in said combustion zone and operable to agitate it to facilitate discharge of said products of combustion from said discharge means therefor, and i. means communicating with said gas outlet means to receive gas therefrom and operable to separate the same from solid products of combustion contained therein.

2. The system according to claim 1 in which said means to feed waste material to the bottom of said cone comprises reciprocable ram means operable at the delivery end of chutes extending downwardly from supply means, and power means to reciprocate said ram means segmentially to feed said material under pressure in a manner to compress the material and comprising an air lock to prevent the ingress of ambient air into said cone except through said inlet ports.

3. The system according to claim 2 further including auger means rotatable rotatable upon a vertical axis in the lower portion of said cone and engageable with compacted material moved thereto by said ram means to move the material progressively upward in said cone for loosening of the material as aforesaid.

4. The system according to claim 3 further including a pair of said ram means respectively connected to opposite sides of a vertical material inlet member depending from the bottom of said cone and discharging material in compacted manner into said member, said auger means being rotatable within said material inlet member.

5. The system according to claim 4 further including additional power means operable to rotate said auger, and a shaft extending upwardly from said auger to said agitating means to rotate said means also.

6. The system according to claim 1 in which said agitating means comprises a transverse member fixed to a vertical shaft extending axially in said cone, power means interconnected to said shaft to rotate said agitating means thereby, and agitating plow members spaced fixedly along said transverse member and depending therefrom for engagement with the sintered material in the upper portion thereof in said cone to agitate it.

7. The system according to claim 6 in which said means to feed waste material to the bottom of said cone comprises ram means communicating with a source of supply of waste material, electric motor power means connected to said ram means to operate the same sequentially in accordance with the contents of the cone being processed, a limit switch in an electric power circuit for said electric motor, and means supporting said shaft of said agitating means for limit vertical movement as the height of the sintering mass of waste material varies in said cone, said limit switch being operated by means connected to said shaft, whereby as the agitating means is lowered due to removal of material engaged by said agitating means said shaft and agitating means are lowered and said electric motor is energized by said switch to drive said ram means to feed material to said cone to restore the same to working level in said cone.

8. The system according to claim 7 in which an auger is mounted for rotation about a vertical axis at the bottom of said cone in communication with said ram means to engage material moved thereby to the bottom of said cone and operable to move said material upwardly in said cone, a tubular shaft coaxial with said shaft of said agitating means and fixed to said auger, said power means commonly driving said coaxial shafts, and means supporting said tubular shaft for rotation but preventing vertical movement, whereby said agitating means and vertical shaft can float vertically a limited amount in accordance with the upper level of said material in said cone.

9. The system according to claim 8 further including a drive gear on the lower end of said vertical shaft driven by said power means, and flexible means extending between said drive gear and tubular shaft operable to effect said common drive of said shafts while permitting said limited relative floating movement of said vertical shaft.

10. The system according to claim 6 further including a horizontal baffle disc fixed to said vertical shaft above said transverse member of said agitating means, and a vane fixed dependingly to the top closure of said cone and disposed tangentially relative to the axis of said disc and engageable with accumulated material thereon to move it toward the perimeter of said baffle disc for discharging therefrom.

11. The system according to claim 10 further including a compartment extending upward from the closure for the top of said cone and comprising said gas outlet means therefrom, said compartment being offset from the axis of said cone and receiving gas for transmittal to further processing mechanism, and said baffle disc being operable to diminish the speed of gas and fine solid particles therein to said compartment for passage from the gas accumulating chamber of said cone.

12. The system according to claim 1 in which said gas outlet means comprise a gas discharge compartment open at the bottom and fixed over an opening in the closure top of said cone, a gas discharge conduit extending at one end laterally from said compartment to conduct hot gas and fine particles therein from said compartment, and spray means connected to a supply of cooling liquid discharges said liquid into said conduit to effect at least initial and/or partial cooling of said gas and entrain fine particles therefrom, said suction means being downstream from said discharge conduit and communicating with a riser from the opposite end of said discharge conduit, a further conduit depending from said opposite end of said discharge conduit and operable to conduct cooling liquid and entrained particles to collection means connected thereto, and said suction means being operable to draw gas into said riser for delivery to further processing equipment.

13. The system according to claim 12 in which said further processing equipment includes a liquid settling tank into which said cooling liquid and entrained fine particles are discharged for setting of heavier components of said liquid to the lower regions thereof for recovery as burnable fuel, and means connected to the upper portion of said settling tank and operable to transfer liquid therefrom to a liquid supply tank from which stored liquid is drawn for use in further equipment downstream from said discharge conduit extending from said compartment on the closure top of said cone.

14. The system according to claim 13 in which the further conduit from said discharge conduit from the gas discharge compartment includes a water seal to prevent ingress of gas to said further conduit.

15. The system according to claim 12 in which said suction means comprises at least one fan communicating with said riser and operated in a direction to withdraw gas from said gas discharge conduit, and said system further including a gas scrubber unit containing a high pressure liquid spray, a gas purifying unit connected by conduit means to the discharge of said gas scrubber unit, and means to discharge at least relatively clean gas from said purifying unit.

16. The system according to claim 15 in which said gas purifying unit includes a gas filtering medium and a mist eliminator thru which the gas from said fan passes to cool and purify the gas, and liquid discharge means extending from said gas purifying unit and connected to said collection means for re-use in the system.

17. The system according to claim 13 further including a liquid cooling tower, conduit means and a pump communicating with said settling tank and operable to draw relatively clean water from the upper portion of said settling tank and deliver it to said cooling tower to cool the liquid and return it to said settling tank.

18. The system according to claim 17 further including a liquid supply tank arranged to receive relatively clear liquid from the upper portion of said liquid settling tank, said system also including a gas scrubber having a high pressure liquid spray and receiving gas from said suction means and operable to entrain impurities in said liquid spray for delivery to a gas purifying unit, and said system further including pump means connected to said liquid supply tank and operable to deliver liquid at desired pressures to said gas scrubber and liquid cooling tower.

19. The system according to claim 18 in which said pump means comprises a plurality of pumps respectively of different pressures and arranged to deliver from said liquid supply tank liquid at high pressure to said gas scrubber and liquid at a lower pressure to said cooling tower.

20. The system according to claim 1 adapted to produce gas and a desirable amount of charcoal by means of adjusting the inlet of air to said inlet ports, said system further including charcoal discharging means in the well of said cone at a level above said air inlet ports and below the top of the mass of material being processed, and means operable to effect removal of charcoal from said discharge means and cool the same.

21. The system according to claim 20 in which said charcoal discharge means comprises a conduit connected at one end to said cone and extending outwardly therefrom, and movable gathering means extending into said cone and actuated by power means to engage charcoal within the portion of the mass of material being sintered which is above said air inlet ports and move it into and along said conduit for removal from said cone.

22. The system according to claim 21 in which said gathering means comprises an auger mounted for rotation within said conduit and extending at one end into said mass of material to engage the same and move it into and along said conduit as aforesaid.

23. The system according to claim 22 in which said agitating means in the cone comprises a cross member rotatable about a vertical axis and having agitating plow members rigidly depending from said cross member and extending downwardly into the mass of material being sintered a sufficient depth to dispose sintered charcoal adjacent said auger, said one end of said auger being spaced below the lower end of said plow members.

24. The system according to claim 22 further including a cooling jacket surrounding said conduit exteriorly of said cone and operable to cool the charcoal.

25. The system according to claim 24 in which said cooling jacket is connected to a source of liquid substantially cooler than the charcoal, said auger means also extending through the portion of the conduit within said jacket, and said power means comprising an electric motor on the outer end of said auger means.

26. A system to generate gas products having useful B.T.U. values from waste cellulosic materials capable of being sintered and charred and comprising in combination:

a. a metallic generator shell comprising a cone positioned vertically and tapering downwardly at a diverging angle and having a gas accumulating chamber in the upper portion thereof, b. a closure extending across the top of said cone and a second panel similar to said closure extending across said cone below said closure to provide a heating space separated from the interior of said cone and having air inlet means, c. material inlet means in the bottom of said cone, d. means to feed waste material progressively into said inlet means for gradual movement upwardly in a manner to permit the angle of divergence of the cone to cause loosening of the material as it moves upwardly in the cone, e. air inlet ports spaced circumferentially around said cone substantially adjacent the vertical midportion thereof and adapted to form a sintering type combustion zone within waste material in said cone in the portion thereof above the level of said ports, said combustion zone effecting heating of air within said heating space, f. gas outlet means communicating with and extending from said gas accumulating chamber, g. air conduit means extending from said heating space to said air inlet ports to provide heated air for combustion to said combustion zone in said cone, h. agitating means movably supported in the upper portion of said cone and engageable with the upper portion of the material in said combustion zone and operable to agitate it to facilitate sintering of the material and discharge of the products of combustion from the upper portion of said cone, and i. suction means communicating with said gas accumulating chamber and operable to withdraw gas and entrained particles of material from said chamber.

27. The system according to claim 26 further including material delivery means extending exteriorly upward adjacent the side of said cone to a source of supply of waste material and operable to discharge said material to said means to feed waste material to said material inlet means in the bottom of cone, and additional conduit means extending from said heating space to said material delivery means to direct heated air into said delivery means in a manner to at least partially heat and evaporate moisture from said material prior to feeding the same to said inlet means in the bottom of said cone.

28. The system according to claim 26 further including a blower connected to said heating space and operable to introduce air into said space under limited pressure, an electric motor connected to said blower to operate it, and a pressure sensitive switch in a circuit to said motor responsive to pressure in said heating space and operable to maintain air pressure therein within pre-determined limits to control combustion within said cone to a desired extent and rate.

29. The system according to claim 26 in which said air inlet ports comprise short tubes extending through the walls of said cone, and nozzles of a smaller diameter than said tubes extending through said tubes into the interior of said cone and also being removable from said tubes to permit access to the interior of said cone for inspection and service to break clinkers and the like, the outer ends of said nozzles being connected to said air conduit means from said heating space, and said nozzles normally closing the outer ends of said tubes to prevent inlet of ambient air into said cone.

30. The system according to claim 26 in which said gas outlet means includes confined passage means extending through said gas accumulating chamber to receive a mixture of gas and solid particles entrained therein, a conduit extending laterally from said confined passage means to receive said mixture for longitudinal movement therealong by said suction means, spray means for cooling liquid discharging into said conduit to entrain solid particles and separate the same from said gas and effect at least initial cooling of said gas, and discharge means at the outer end of said conduit arranged and operable respectively to receive said gas for transfer to subsequent purifying means and transfer said liquid and entrained particles to additional treatment means.

31. The system according to claim 26 further including a shaft extending axially vertically in said cone from the lower portion thereof to a bearing supported adjacent said closure for the top of the cone, an auger connected to the lower end of said shaft and comprising said means to feed material into said material inlet means as aforesaid, and said agitating means being connected to the upper end portion of said shaft for rotation thereby, and power means interconnected to said auger to effect rotation of said shaft.

32. The system according to claim 31 in which said means to feed waste material to said cone further comprises reciprocable ram means operable to receive waste material from supply means and forcibly move it to said auger, and a reversible electric motor connected to said ram means and operable to cycle the ram means for sequential movement in feeding direction and retracting movement.

33. A system to generate gas products having useful B.T.U. values from waste cellulosic materials capable of being sintered and charred and comprising in combination:

a. a generator shell comprising a cone positioned vertically and tapering downwardly at a diverging angle and having a gas accumulating chamber in the upper portion thereof, b. closure means for the top of said cone to define part of said chamber, c. material inlet means in the bottom of said cone, d. means to feed waste material progressively into said inlet means for gradual movement upwardly in said cone, e. air inlet ports spaced circumferentially around said cone substantially adjacent the vertical midportion thereof and adapted to form a sintering type combustion zone within waste material in said cone above the level of said ports, f. gas outlet means communicating with and extending from the upper portion of said gas accumulating chamber, g. agitating means supported in the upper portion of said cone and engageable with the upper portion of the material in said combustion zone and operable to agitate it to facilitate substantially even sintering of the material therein, h. suction means downstream from the gas accumulating chamber of said cone and operable to withdrawn gas therefrom, i. a conduit extending from said gas outlet means and provided with spray means for cooling liquid to entrain from the gas any solid particles of combustion products, j. means to separate gas from said liquid and entrained particles, k. means to subject said gas to high pressure liquid spray means, and l. a purifying unit adapted to receive gas and liquid therefrom and having means to filter said gas and eliminate mist and discharge cooled clean gas therefrom and direct the separated liquid to a settling tank for re-use.

34. The system according to claim 33 further including a settling tank arranged to receive liquid and any entrained particles from said purifying unit and also from said means to separate gas from liquid, said settling tank being arranged to hold in the lower portion thereof heavier components of the liquid which settle from the lighter liquid, and means to pump said lighter liquid to said spray means in said conduit and return it to said settling tank.

35. The system according to claim 34 further including a liquid storage tank, means connecting said storage tank to the upper portion of said settling tank for transfer of lighter liquid to said storage tank, multiple pump means connected to said storage tank respectively of different pressure capacities, and means respectively connecting the pump of higher pressure to the high pressure spray of said means to subject said gas thereto and connecting the pump of lower pressure to said spray means in said conduit and also to spray means directed against the filter means in said purifying unit.

* * * * *